US005375732A

United States Patent [19]

Bowers et al.

[11] Patent Number: 5,375,732

[45] Date of Patent: Dec. 27, 1994

[54] VACUUM RELEASE GARBAGE CAN

[76] Inventors: John J. Bowers; Charles A. Sherman, both of 5870 Bowers La., Coggon, Iowa 52218

[21] Appl. No.: 240,873

[22] Filed: May 11, 1994

[51] Int. Cl.[5] ..... B65D 25/14

[52] U.S. Cl. ..... 220/404; 220/908

[58] Field of Search ..... 220/404, 908, 729, 403, 220/407, 408, 410

[56] References Cited

U.S. PATENT DOCUMENTS

| | | | |
|---|---|---|---|
| 4,122,973 | 10/1978 | Ahern . | |
| 4,238,868 | 12/1980 | Sternberg . | |
| 4,294,379 | 10/1981 | Bard | 220/404 |
| 4,416,197 | 11/1983 | Kehl | 220/908 |
| 4,715,572 | 12/1987 | Robbins, III et al. . | |
| 4,913,308 | 4/1990 | Culbertson | 220/404 |
| 5,036,999 | 8/1991 | Bitsch | 220/908 |
| 5,065,891 | 11/1991 | Casey . | |
| 5,156,290 | 10/1992 | Rodrigues | 220/908 |
| 5,160,063 | 11/1992 | Bailey | 220/404 |
| 5,269,434 | 12/1993 | Labuda | 220/404 |

*Primary Examiner*—Joseph Man-Fu Moy

[57] ABSTRACT

A garbage container includes an air conduit directed within the container coextensively of a side wall thereof extending into the container cavity, such that the air conduit includes side walls having side wall openings to effect vacuum release when a plastic liner is positioned within the garbage can.

3 Claims, 2 Drawing Sheets

VACUUM RELEASE GARBAGE CAN

BACKGROUND OF THE INVENTION

1. Field of the Invention

The field of invention relates to garbage can structure, and more particularly pertains to a new vacuum release garbage can wherein the same is arranged to prevent vacuum adherence of a refuse polymeric liner within a refuse container.

2. Description of the Prior Art

Various refuse container holders and bag structure holders are available in the prior art as indicated by U.S. Pat. Nos. 4,238,868; 5,065,891; 4,715,572; 4,294,379; and 4,122,973.

The instant invention attempts to overcome deficiencies of the prior art by providing for an air conduit directed coextensively along a side wall of the container extending from the container entrance opening to the floor providing for vacuum release of the container liner and in this respect, the present invention substantially fulfills this need.

SUMMARY OF THE INVENTION

In view of the disadvantages inherent in the known types of refuse container structure now present in the prior art, the present invention provides a vacuum release garbage can wherein the same is arranged to prevent vacuum adherence of a polymeric liner within a garbage can.

To attain this, the present invention provides a garbage container including an air conduit directed within the container coextensively of a side wall thereof extending into the container cavity, such that the air conduit includes side walls having side wall openings to effect vacuum release when a plastic liner is positioned within the garbage can.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new vacuum release garbage can which may be easily and efficiently manufactured and marketed.

It is a further object of the present invention to provide a new vacuum release garbage can which is of a durable and reliable construction.

An even further object of the present invention is to provide a new vacuum release garbage can which is susceptible of a low cost of manufacture with regard to both materials and labor, and which accordingly is then susceptible of low prices of sale to the consuming public, thereby making such vacuum release garbage cans economically available to the buying public.

Still yet another object of the present invention is to provide a new vacuum release garbage can which provides in the apparatuses and methods of the prior art some of the advantages thereof, while simultaneously overcoming some of the disadvantages normally associated therewith.

Even still yet another object of the present invention is to provide a new vacuum release garbage can which includes an air conduit directed within the container coextensively of a side wall thereof extending into the container cavity, such that the air conduit includes side walls having side wall openings to effect vacuum release when a plastic liner is positioned within the garbage can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
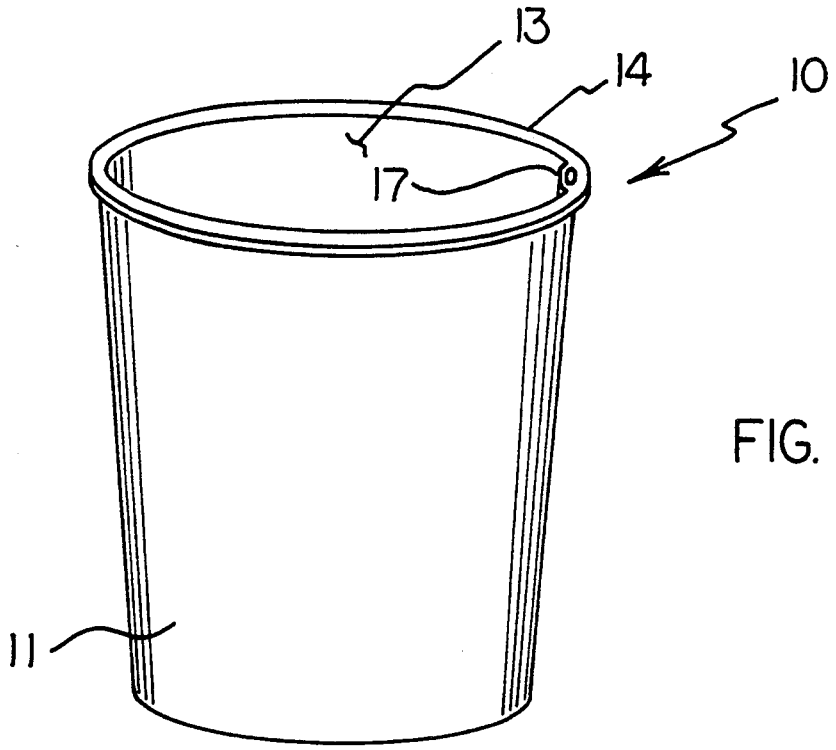
FIG. 1 is an isometric illustration of the invention.
Figure 2:
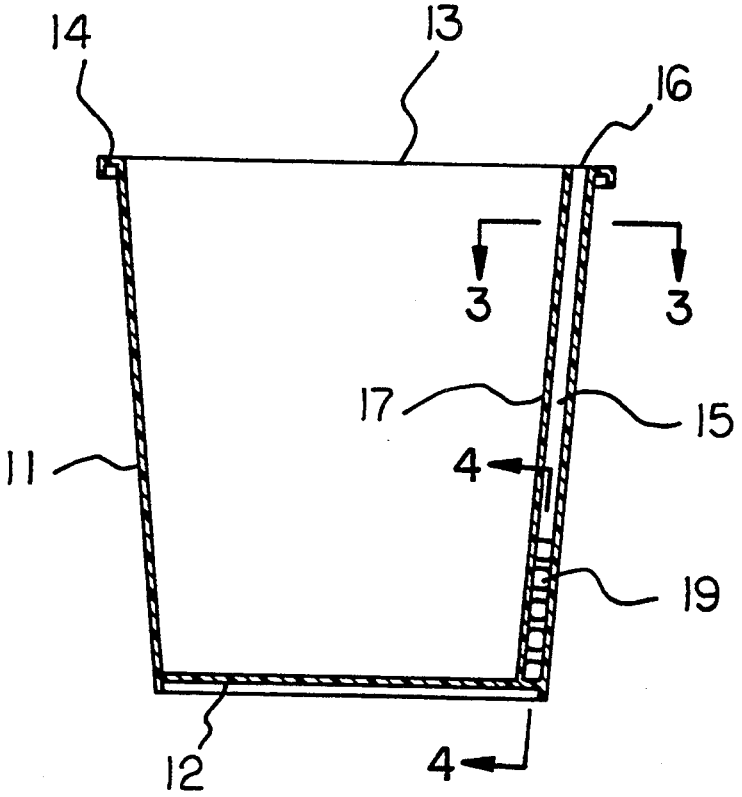
FIG. 2 is an orthographic view in cross-section of the instant invention.
Figure 3:
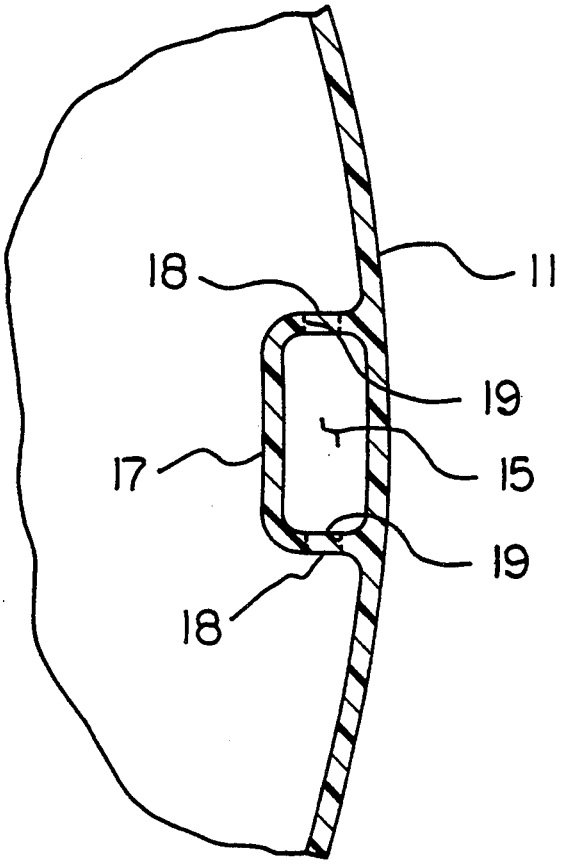
FIG. 3 is an orthographic view, taken along the lines 3—3 of FIG. 2 in the direction indicated by the arrows.
Figure 4:
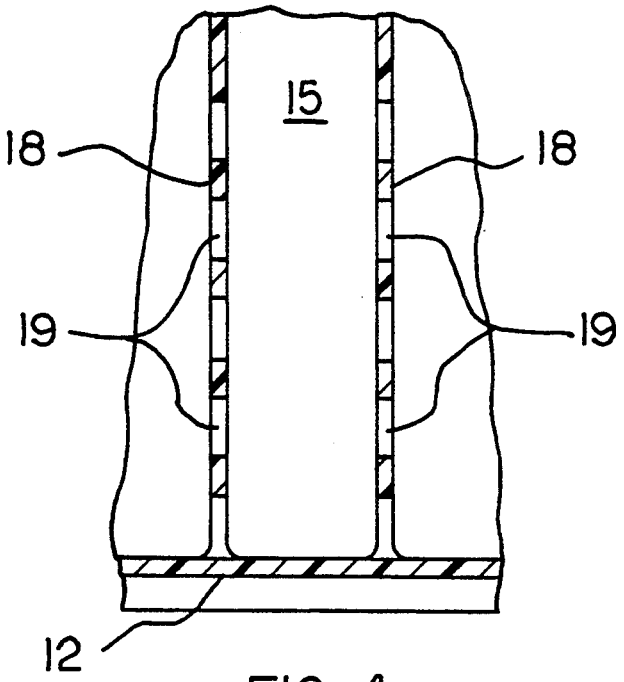
FIG. 4 is an orthographic view, taken along the lines 4—4 of FIG. 2 in the direction indicated by the arrows.

With reference now to the drawings, and in particular to FIGS. 1–4 thereof, a new vacuum release garbage can embodying the principles and concepts of the present invention and generally designated by the reference numeral 10 will be described.

More specifically, the vacuum release garbage can 10 of the instant invention comprises a substantially cylindrical, continuous side wall 11 having a floor 12 and an entrance opening 13, with a container cavity extending between the entrance opening and the floor. The entrance opening 13 includes an annular flange 14 to permit manipulation of the device 10, as well as the snap fitting of a lid or the like over the entrance opening 13. An air conduit 15 extends coextensively within the garbage can extending from the annular flange 14 to the floor 12. The air conduit 15 includes an opening 16 coplanar with the entrance opening 13, and the air conduit further includes a front wall 17 and side walls 18. Each of the side walls 18 is integrally molded with the side wall 11 and includes side wall openings 19, such that when a polymeric bag (not shown) is present within and being removed from the garbage can, the air conduit 15 prevents vacuum adherence of the bag within the garbage can as the conduit 15 permits pressure equalization within the garbage can between such polymeric liner and the interior surface of the side wall 11. It should be understood that a plurality of such air conduits 15 of like construction may be employed, and that the side wall openings 19 may be positioned along an entire longitudinal length of the side walls 18.

An important aspect of the present invention over the prior art is that the side wall openings 19 extend along the side walls 18 of the air conduit 15, thereby precluding blockage of air flow through the entire conduit should one or more, but not all, of the side wall openings become sealed through an engagement with the polymeric bag or other objects within the can 10. Further, positioning the side wall openings 19 on opposed side walls 18, not just one of the side walls, allows the polymeric bag to be rotated within the can during removal thereof while assuring that at least one of the side walls will have at least one side wall opening unobstructed to permit air flow through the conduit 15. In addition, positioning the openings 19 along the front wall 17 of the air conduit 15 is undesirable inasmuch as blockage of such front wall openings by the polymeric bag would be almost completely assured. Lastly, it is desirable for the side walls 18, as well as the front wall 17, to extend into sealing engagement with the floor 12, such that fluid, or trash leachate, is not unduly agitated by a bubbling of air through the air conduit, as the first of the openings 19 is substantially spaced from the floor and arranged to direct air flow into a substantially parallel stream relative to any fluid residing on the container floor. Such reduced agitation of the leachate results in less permeation of the attendant odor of the leachate.

As to the manner of usage an the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A vacuum release garbage can comprising:

a substantially cylindrical, continuous side wall having a floor and an entrance opening, with the entrance opening including an annular flange extending in surrounding relationship relative to the entrance opening, with a container cavity extending between the entrance opening and the floor;

an air conduit integrally mounted to the side wall within the cavity and extending into the cavity from the entrance opening into a sealing relationship with the floor, the air conduit having a top end coplanar with the entrance opening, and the air conduit further having a front wall and spaced side walls within the cavity, each of the side walls having a row of side wall openings in pneumatic communication with the cavity and through the air conduit.

2. A garbage can as set forth in claim 1, wherein a first one of said openings on each of the side walls is substantially spaced from the floor and arranged to direct air flow into a substantially parallel stream relative to the floor.

3. A garbage can as set forth in claim 2, wherein the side wall openings are positioned along an entire longitudinal length of each of the side walls.

* * * * *